United States Patent [19]

Satchell et al.

[11] 4,418,580

[45] Dec. 6, 1983

[54] PIPETTOR MECHANISM AND DISPOSABLE TIP AND PISTON ASSEMBLY

[75] Inventors: Fred E. Satchell, Chesterfield; William D. Cornell, Ballwin, both of Mo.; Mark O. Uitz, Mountain View, Calif.; Clarence L. Walker, Webster Groves, Mo.

[73] Assignee: Sherwood Medical Company, St. Louis, Mo.

[21] Appl. No.: 310,489

[22] Filed: Oct. 13, 1981

[51] Int. Cl.[3] ..... B01L 3/02

[52] U.S. Cl. ..... 73/864.13; 73/864.14

[58] Field of Search ..... 73/864.13, 864.14

[56] References Cited

U.S. PATENT DOCUMENTS

| | | | |
|---|---|---|---|
| 3,991,617 | 11/1976 | d'Autry | 73/864.14 |
| 4,023,716 | 5/1977 | Shapiro | 73/864.13 |
| 4,154,108 | 5/1979 | Vollinger | 73/864.13 |
| 4,362,064 | 12/1982 | d'Autry | 73/864.13 |

*Primary Examiner*—S. Clement Swisher

*Attorney, Agent, or Firm*—Stanley N. Garber; Gregory E. Upchurch; William R. O'Meara

[57] ABSTRACT

A disposable tip and piston assembly for a pipettor mechanism includes a hollow tip member adapted to be detachably connected on the distal end of the pipettor mechanism, and a piston member slidably disposed within the tip. The pipettor mechanism includes a plunger rod adapted to detachably engage the piston, and an ejector mechanism which permits rapid removal of the tip and piston assembly without the user contacting the assembly. The piston member is adapted to directly contact the substance being pipetted, for high accuracy in pipetting. The ejector mechanism and the detachable connection of the tip and piston assembly to the pipettor mechanism insulates the pipettor mechanism and its operator from contamination by the substance being pipetted.

18 Claims, 28 Drawing Figures

PIPETTOR MECHANISM AND DISPOSABLE TIP AND PISTON ASSEMBLY

FIELD OF THE INVENTION

The present invention relates to pipettors useful in laboratories for drawing in and dispensing relatively precise quantities of substances (e.g., blood). The field of the invention includes both pipettors and disposable tips for use therewith.

BACKGROUND OF THE INVENTION

The more popular pipettors in use presently are of two types: (1) solid displacement pipettors, and (2) non-solid displacement pipettors.

A solid displacement pipettor, as shown, for example, in U.S. Pat. No. 3,506,164, includes a piston which comes into direct contact with the liquid being sampled. This provides greater accuracy in drawing in and dispensing measured quantities of samples.

However, such pipettors must be carefully cleaned after each use to prevent contamination of subsequent samples to be analyzed. A further disadvantage of solid displacement pipettors is potential contamination by laboratory personnel who must handle the pipettors and/or clean them.

A non-solid displacement pipettor, as shown, for example, in U.S. Pat. No. 3,766,784, employs a disposable tip which provides an air space between the piston and the sample itself, such that the piston does not contact the sample. Such pipettors are relatively contamination-free, since laboratory personnel do not come into contact with the sample being analyzed during sampling or cleaning. In fact, cleaning is virtually unnecessary since no portion of the pipettor itself (as distinguished from the disposable tip) comes into contact with the sample.

However, pipetting with non-solid displacement pipettors is less accurate than pipetting with solid displacement pipettors. The compressibility of the air between the piston and the sample gives rise to the danger of inaccurate volume measurement, particularly where very small volumes are pipetted.

U.S. Pat. No. 4,084,730 and 4,249,419 show pipettors having disposable pistons. However, these pipettors are cumbersome and do not permit ready, contamination-free disposition and replacement of the tips and pistons.

OBJECTS OF THE INVENTION

Among the objects of the present invention are the following:

(1) the provision of a pipetting assembly which retains the advantages and eliminates the disadvantages of solid displacement and non-solid displacement pipetting;

(2) the provision of a disposable tip and piston assembly which permits precision pipetting in a contamination-free manner; and (3) the provision of an ejector mechanism which permits the operator to simultaneously eject the disposable tip and piston from the pipettor without contacting the tip or piston.

SUMMARY OF THE INVENTION

The foregoing and other objects and advantages of the present inventin have been realized by providing a disposable tip and piston assembly for pipettors, whereby the piston which contacts the sample to be pipetted is discarded with the disposable tip after use. The pipettor with which the disposable piston and tip assembly is designed to be used includes a plunger rod which detachably connects to the disposable piston in each disposable tip, and an ejector mechanism which removes the tip and piston assembly quickly and conveniently, without the need for contact by any personnel.

Other objects and advantages of the present invention will become apparent from a review of the detailed description of a preferred embodiment, below, and the accompanying drawings to which the detailed description refers.

DETAILED DESCRIPTION OF PREFERRED EMBODIMENTS

Figure 23:
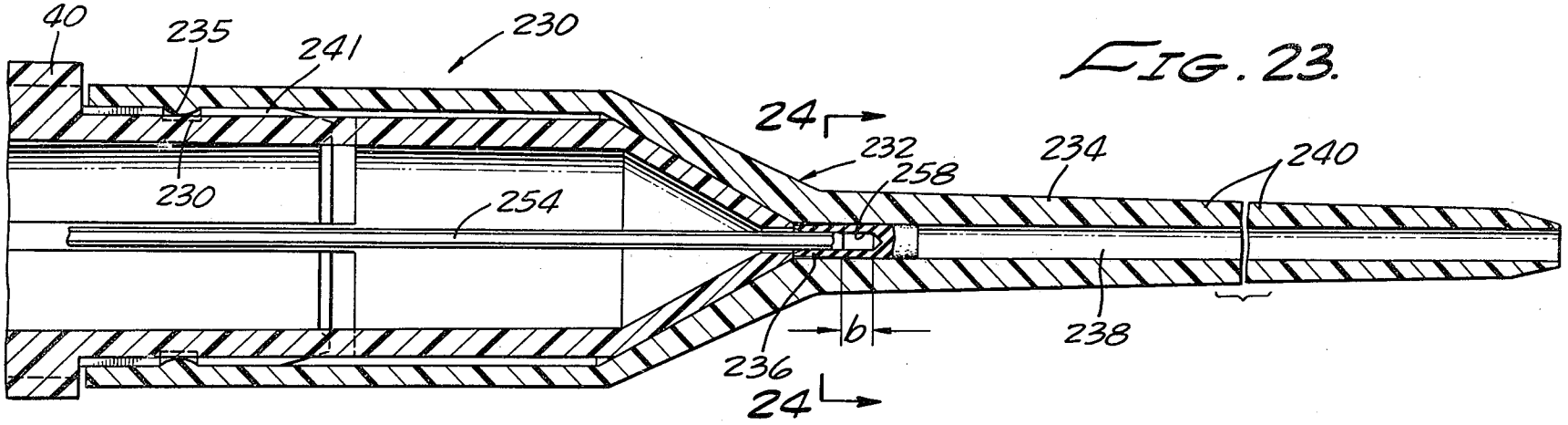
FIG. 23 is a partial sectional view, similar to FIG. 16, showing the distal end of the pipettor mechanism, and a second embodiment of a tip and piston assembly mounted thereon.
Figure 25:
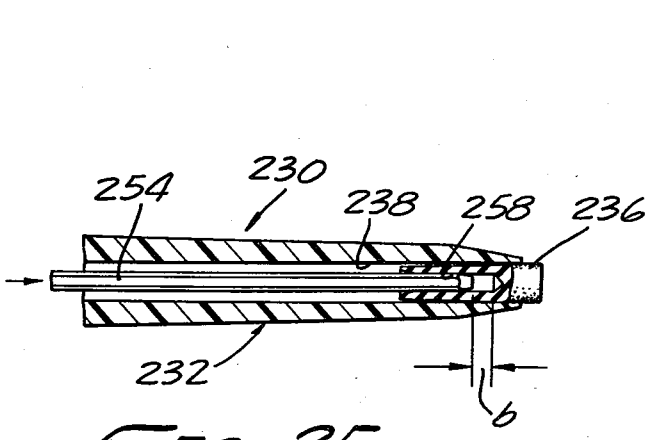
FIG. 25 is a partial longitudinal sectional view of the forward end of the tip and piston assembly shown in FIG. 23, with the piston located in its forward-most position in the forward end of the tip.
Figure 24:
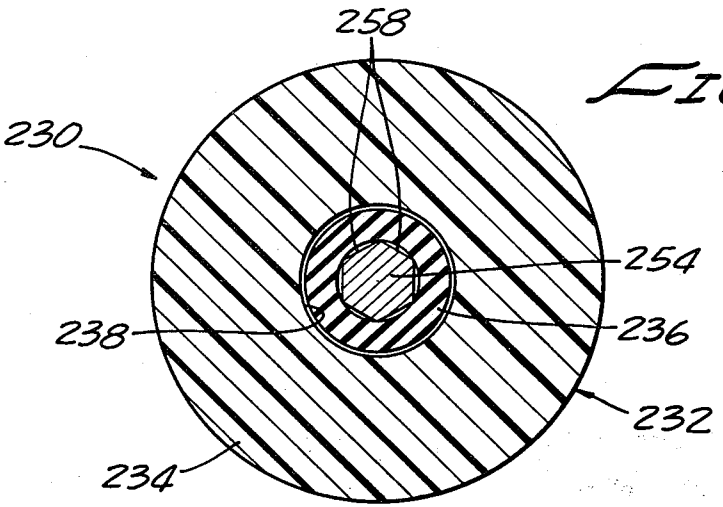
FIG. 24 is an enlarged cross-sectional view taken along the plane 24—24 of FIG. 23 and looking in the direction of the arrows.
Figure 26:
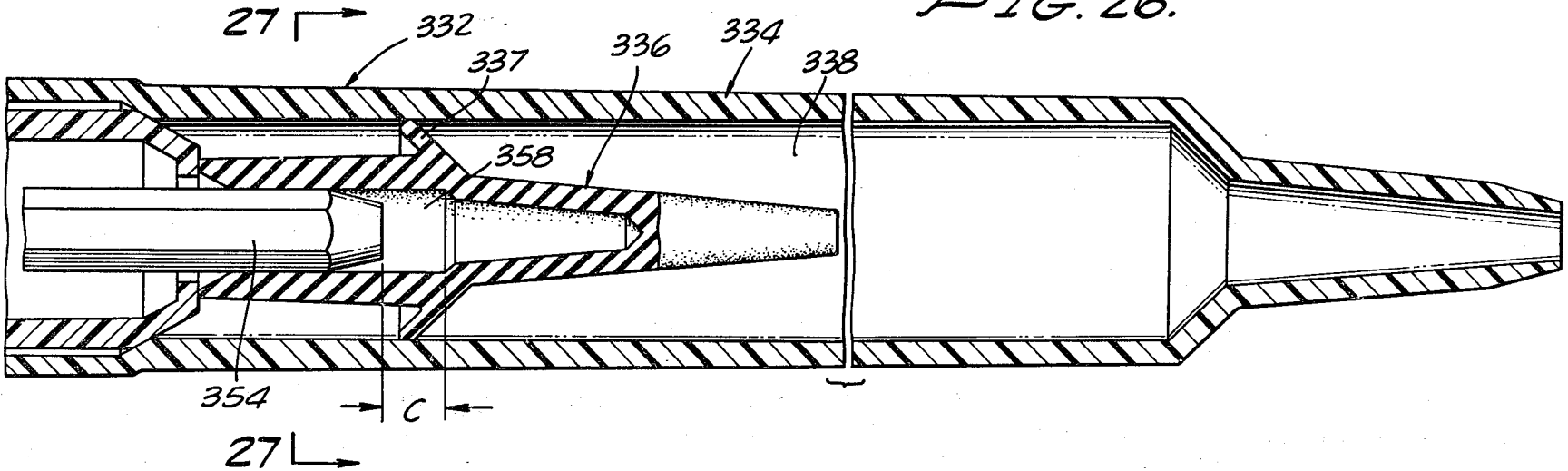
FIG. 26 is an enlarged, partial, longitudinal sectional view of a third embodiment of a tip and piston assembly of the present invention.
Figure 28:
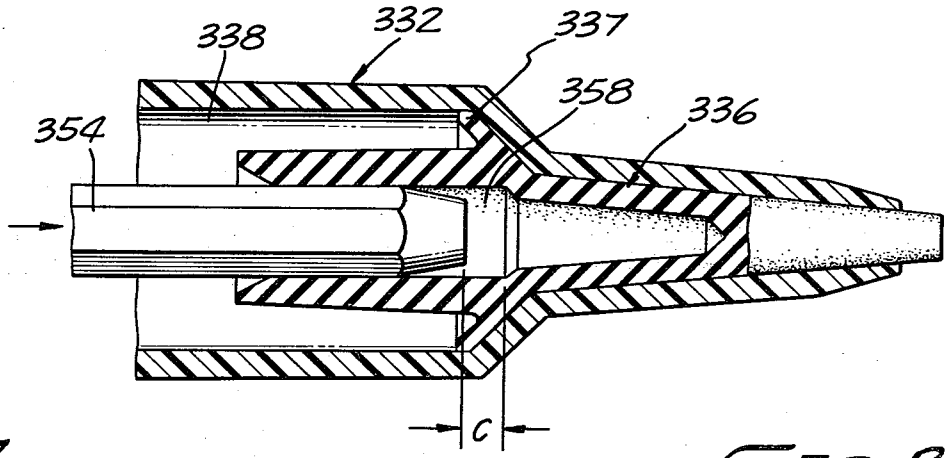
FIG. 28 is a partial longitudinal sectional view of the forward end of the tip and piston assembly shown in FIG. 26, but showing the piston located in its forward-most position in the forward end of the tip.
Figure 27:
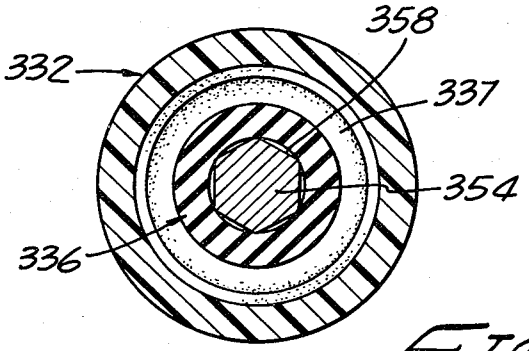
FIG. 27 is a cross-sectional view taken along the plane 27—27 of FIG. 26 and looking in the direction of the arrows.

The present invention includes a pipettor 30 equipped with an ejector mechanism 98, and a disposable tip and piston assembly, adapted to be detachably mounted on the forward end of the pipettor 30. There are three embodiments of the disposable tip and piston assembly of the present invention which are shown in the drawings. A medium-size tip and piston assembly 32, is shown in FIGS. 1–4, 15, 16, 19, 21 and 22; a smaller size tip and piston assembly 232 is illustrated in FIGS. 23–25; and a larger size assembly 332 is shown in FIGS. 26–28.

THE PIPETTOR 30

Figure 1:
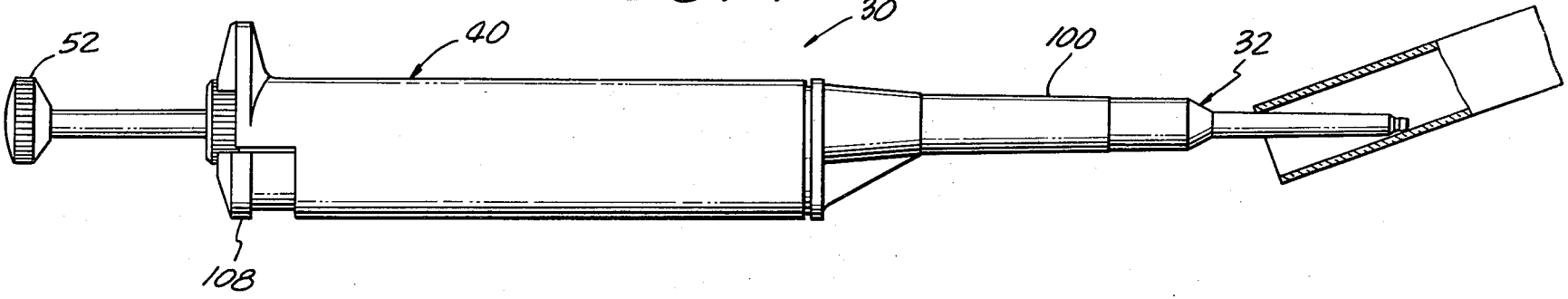
FIG. 1 is an elevation view of the pipettor of the present invention.
Figure 2:
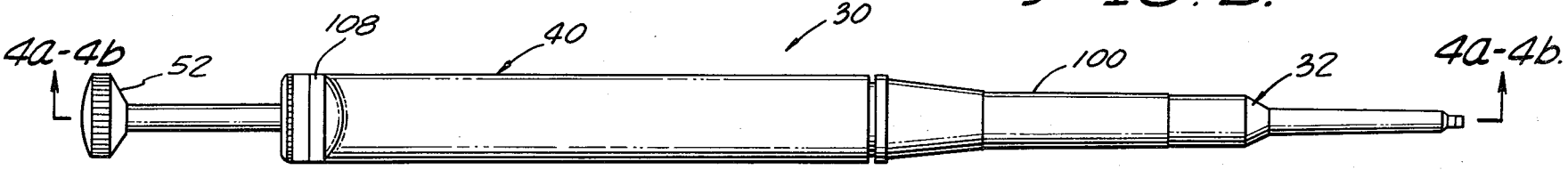
FIG. 2 is a side elevation view of the pipettor of the present invention, rotated 90 degrees from the position shown in FIG. 1.
Figure 3:
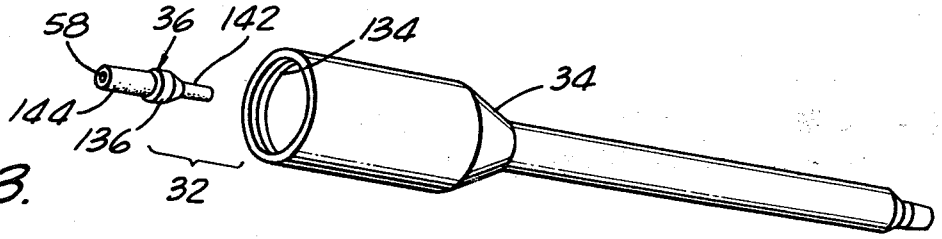
FIG. 3 is a perspective exploded view of the disposable tip of the present invention, and the piston which is slidably housed in the tip.
Figure 4:
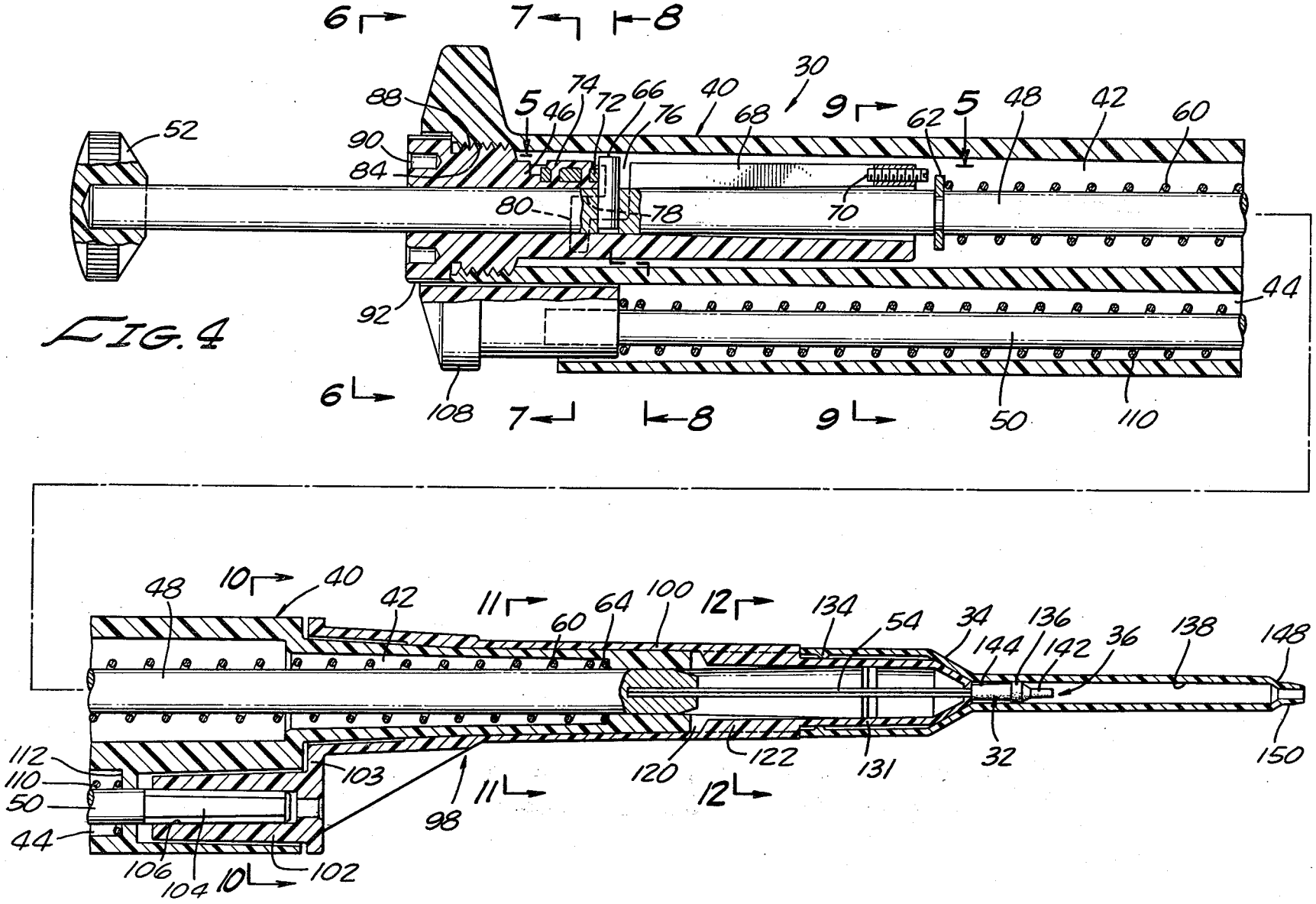
FIG. 4 is an enlarged cross-sectional view taken along the plane 4*ab*—4*ab* of FIG. 2, and looking in the direction of the arrows, with a disposable tip and piston assembly of the present invention mounted on the forward end of the pipettor.

Referring to FIG. 4 (FIG. 4), the pipettor 30 comprises a housing 40 having a piston plunger chamber 42 and an ejector plunger chamber 44 extending therethrough. A bushing 46 is mounted in the rear end of the piston plunger chamber 42, and a piston plunger 48, having a thumb knob 52 on the rear end thereof, is slidably disposed through the bushing 46. An ejector plunger 50, having a thumb knob 108 on the rear end thereof, is slidably disposed in and extends through the ejector plunger chamber 44.

Figure 16:
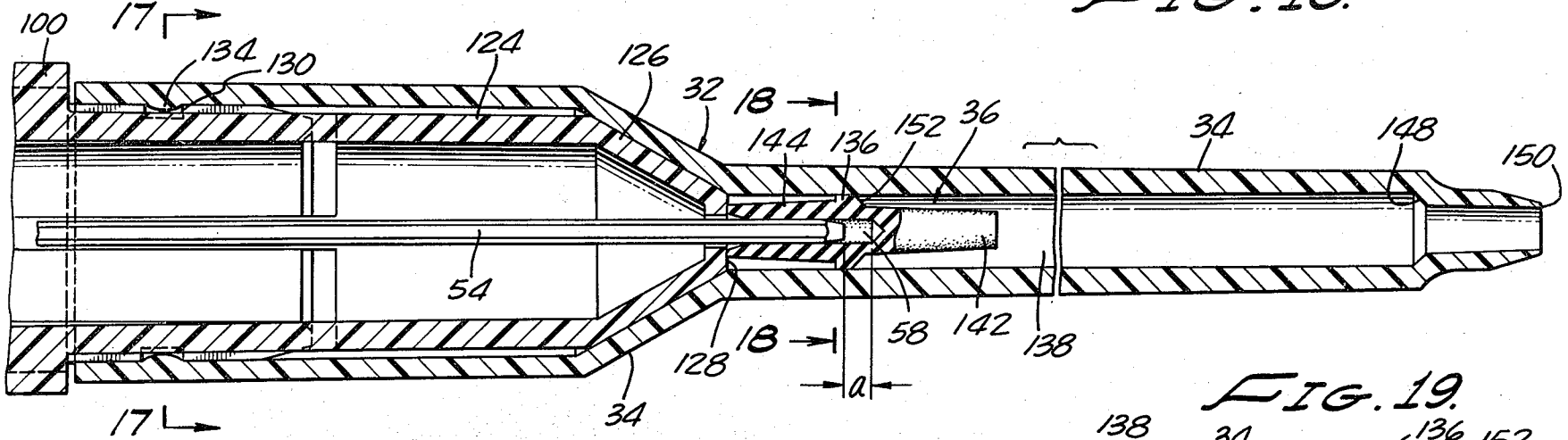
FIG. 16 is a cross-sectional view of the forward end of the pipettor mechanism and the tip and piston assembly mounted thereon, with the piston disposed in its rear-most position.
Figure 20:
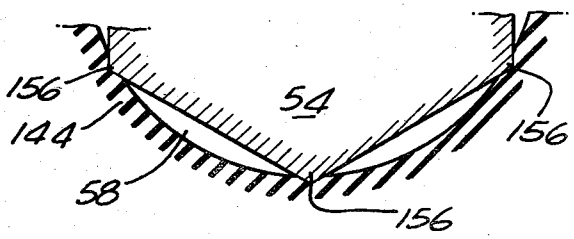
FIG. 20 is an enlarged, partial, sectional view illustrating the manner in which the forward end of the plunger rod engages the interior wall of the bore in the piston.
Figure 18:
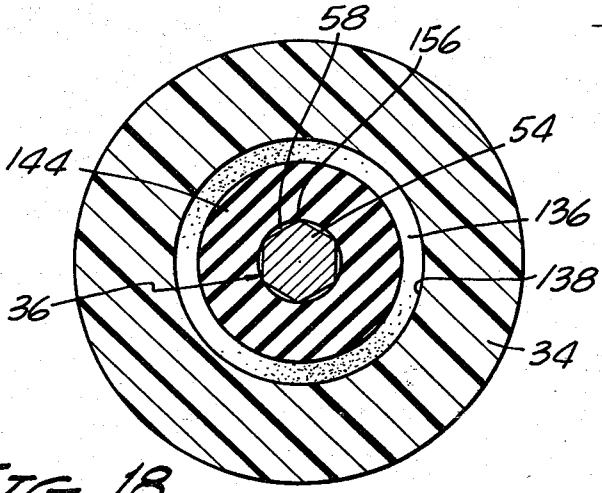
FIG. 18 is an enlarged sectional view taken along the plane 18—18 of FIG. 16 and looking in the direction of the arrows.
Figure 17:
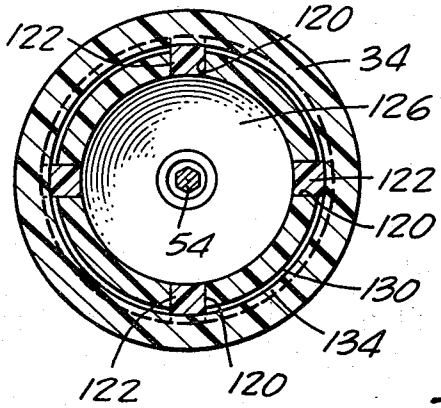
FIG. 17 is a sectional view taken along the plane 17—17 of FIG. 16 and looking in the direction of the arrows.

A piston rod 54 is mounted on the forward end of the piston plunger 48 and extends forwardly therefrom, for detachably engaging the piston 36 of a disposable tip and piston assembly 32. The piston rod 54 is preferably hexagonally-shaped in cross-section (see, e.g., FIG. 18) to provide a relatively tight fit of its forward end in a bore 58 in the rear end of the piston 36. The manner in which the corners 156 of the hexagonal periphery of the piston rod 36 engage the interior wall of the piston bore 58 is best shown in FIGS. 16, 18 and 20.

The piston plunger 48 and the piston rod 54 are urged rearwardly in the piston plunger chamber 42 by a return spring 60. The return spring 60 is disposed between a retainer ring 62 (FIG. 4) mounted on the piston plunger 48 and an annular seat 64 (FIG. 4) formed in the forward end of the chamber 42.

Figure 5:
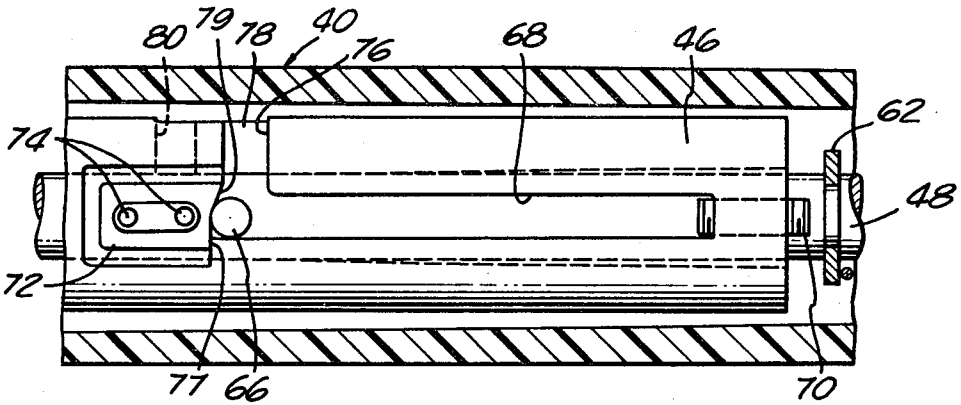
FIG. 5 is a partial cross-sectional view taken along the plane 5—5 of FIG. 4, looking in the direction of the arrows.
Figure 8:
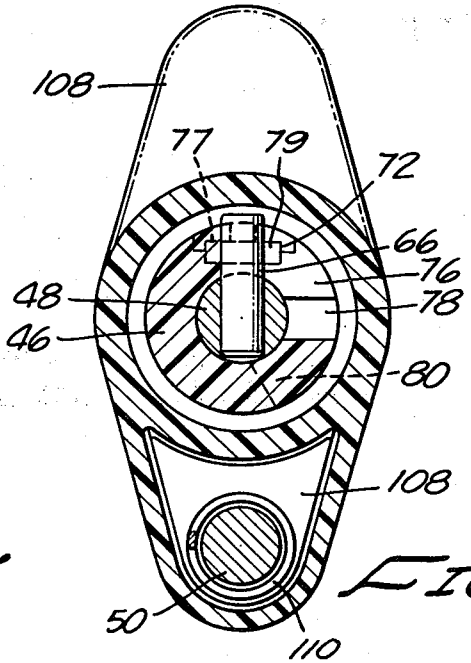

The structure which limits and guides movement of the piston plunger 48 is shown in FIGS. 4 and 5. A radial guide pin 66 is mounted in a radial bore in the piston plunger 48. The outer end of the radial pin 66 extends into a guide slot in the bushing 46. The guide slot includes a forward longitudinal slot 68, a forward arcuate slot 76, a rear longitudinal slot 78, and a rear arcuate slot 80.

Figure 7:
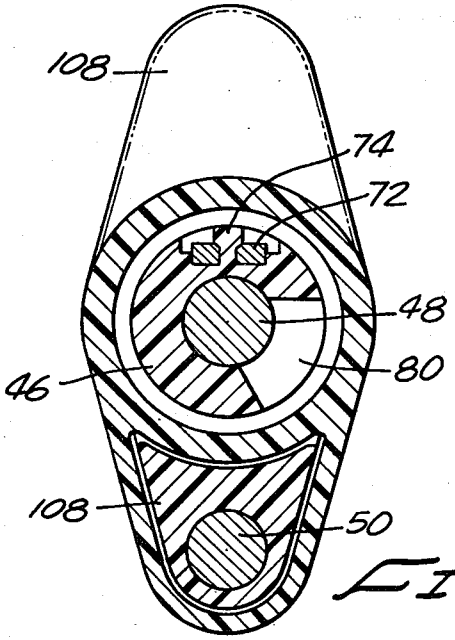

The outer end of the pin 66 rides in the forward longitudinal slot 68 during intake and dispensing of the sample being transferred by the pipettor. As best shown in FIGS. 4, 5 and 15*a*, forward movement of the pin 66 in the slot 68 (and, per force, forward movement of the piston plunger 48, the piston rod 54, and the piston 36) is limited by a set screw 70 mounted in a threaded hole in the forward end of the bushing 46. Rearward movement of the pin 66 in slot 68 is limited by a plate 72 mounted on the bushing 46 just behind the rear end of the slot 68. The bushing 46 is preferably fabricated of plastic. The plate 72 is preferably fabricated of metal, molded into the bushing and retained in place by integrally-formed pins or studs 74, 74 (FIGS. 5 and 7).

As best shown in FIG. 5, the forward or distal edge of the metal plate 72 is not straight. There is a nesting angle formed by two edges, 77 and 79, in which the radial pin 66 nests when the return spring 60 urges the pin 66 to its rear position, as illustrated in FIGS. 4 and 5. This nesting angle functions to prevent the mechanism from being inadvertently moved to its tip ejection mode (described later).

As shown in FIGS. 4, 5, 7–9 and 15*a*, the rear end of the forward longitudinal slot 68 opens into one end of the forward arcuate slot 76; the other end of the slot 76 opens into the forward end of the rear longitudinal slot 78; and the rear end of the rear longitudinal slot 78 opens into one end of the rear arcuate slot 80. The longitudinal slots 68 and 78 are displaced approximately ninety degrees from one another, which is the approximate arcuate length of the forward arcuate slot 76. The rear arcuate slot 80 is shorter (e.g., by about ten or fifteen degrees) than the forward arcuate slot 76.

The arrangement of slots 68, 76, 78 and 80 permit the effective ejection of a contaminated tip and piston assembly 32 as described below in the section of this specification headed "Operation."

Figure 6:
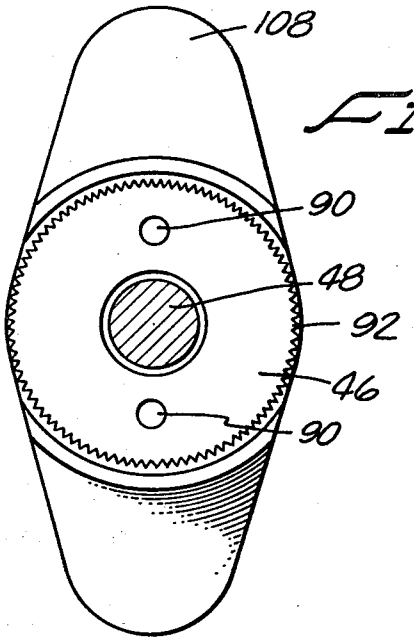
FIGS. 6, 7, 8 and 9 are sectional views taken along the planes 6—6, 7—7, 8—8 and 9—9, respectively, of FIG. 4, and looking in the direction of the respective arrows.
Figure 9:
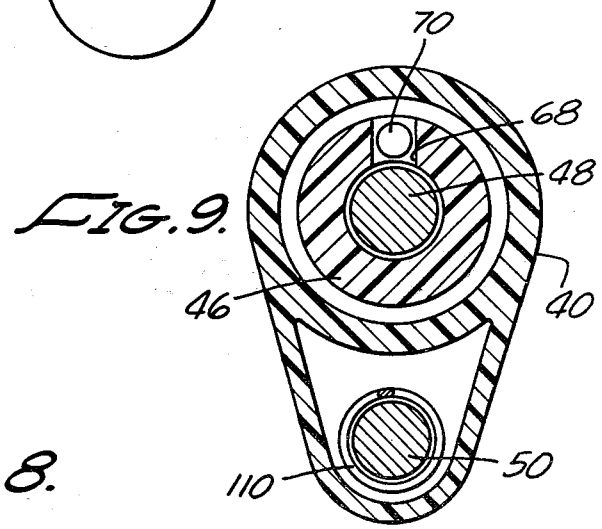

As shown in FIG. 4, the bushing 46 is mounted in the rear end of the piston plunger chamber 42 by means of exterior screw threads 84 on the rear end of the bushing 46 and interior screw threads 88 in the rear end of the chamber 42. Sockets 90, 90 in the rear end face of the bushing 46 are provided to receive a spanner wrench (not shown) to facilitate mounting the bushing 46 in the housing 40. Knurling or serrations 92 (FIG. 6) on the rear end of the bushing 46 facilitate manual mounting of the bushing 46 in the housing 40.

THE EJECTOR MECHANISM 98

The ejector mechanism 98 of the present invention is best illustrated in FIGS. 4, 14, 21 and 22.

Figure 21:
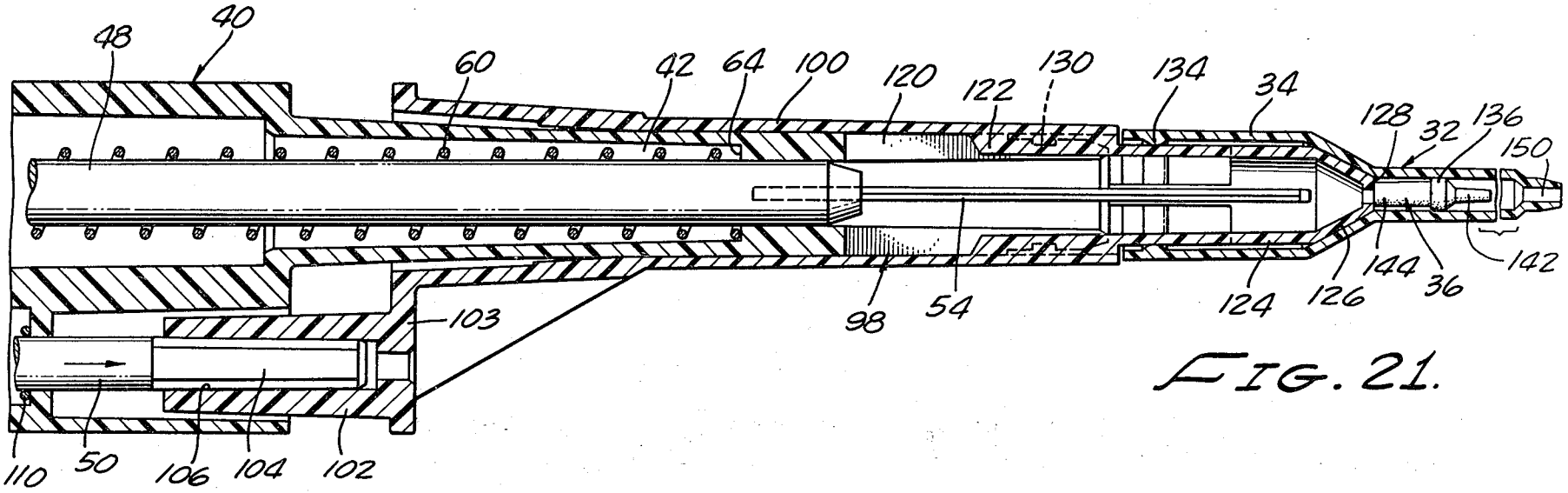
FIG. 21 is a partial sectional elevation view of the pipettor mechanism and the tip and piston assembly, showing the positions occupied during ejection of the tip and piston assembly from the forward end of the pipettor mechanism.

The ejector mechanism 98 includes an ejector sleeve 100 slidably mounted on the forward portion of the pipettor housing 40, and an offset actuator stub 102 integrally connected to the ejector sleeve 100 by a connecting web 103. The actuator stub 102 has a rearwardly-opening bore 106 which receives the forward end 104 of the ejector plunger 50. The forward end 104 of the ejector plunger 50 may be hexagonally shaped in cross-section so as to form a tight fit in the bore 106 of the offset actuator stub 102 of the ejector sleeve 100, as shown in FIGS. 4 and 21.

A thumb knob 108 is mounted on the rear end of the ejector plunger 50; and a return spring 110 is disposed between the knob 108 and an annular wall 112 adjacent the forward end of the ejector plunger chamber 44. The return spring 110 normally maintains the ejector plunger 50 in the rearward position illustrated in FIG. 4.

Figures 10, 11, 12, 13, 14:
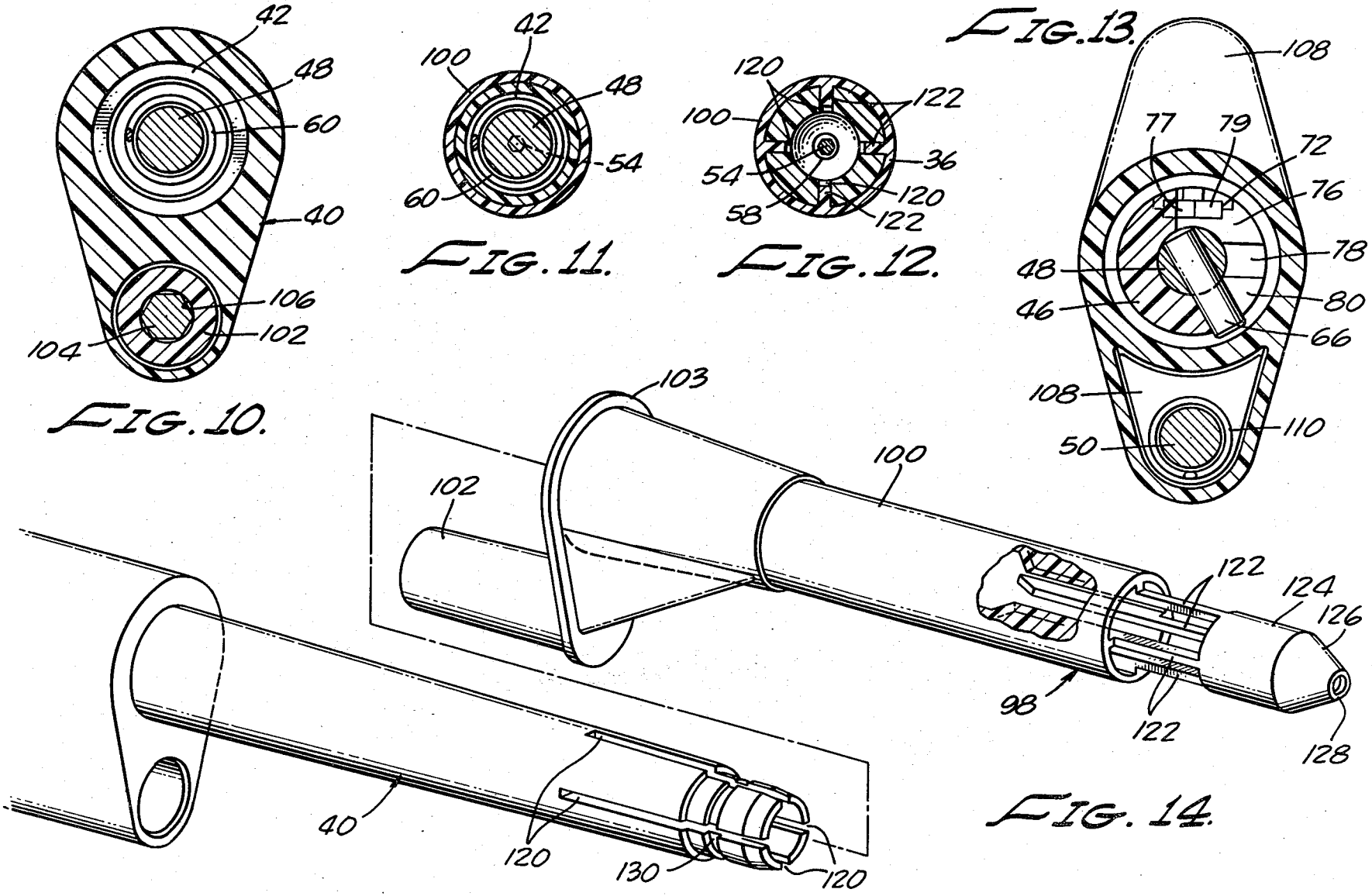
FIGS. 10, 11 and 12 are sectional views taken along the planes 10—10, 11—11 and 12—12 of FIG. 4, and looking in the direction of the arrows.
FIG. 13 is a cross-sectional view taken along the plane 8—8 of FIG. 4, with the plunger assembly rotated approximately 150 degrees from the position illustrated in FIGS. 4 and 8.
FIG. 14 is a perspective exploded view illustrating the forward end of the pipettor of the present invention, with the ejector mechanism removed to illustrate details of construction.

As best shown in FIGS. 12 and 14, the forward end of the pipettor housing 40 is provided with longitudinally-extending, circumferentially-spaced slots 120, 120, 120, 120; and the forward end of the ejector sleeve 100 is provided with longitudinally-extending, circumferentially-spaced slats 122, 122, 122, 122, which ride in the slots 120. The forward ends of the slats 122 in ejector sleeve 100 are integrally connected to a nose portion which comprises a cylindrical section 124 and a conical section 126. The forward end of the conical section 126 terminates in an annular forward end 128 which is adapted to engage the rear end of the piston 36 in the tip-and-piston assembly 32 (see FIG. 21) during the tip ejection procedure described below in the section of this specification headed "Operation."

The forward end of the pipettor housing 40 (FIG. 14) is reduced in diameter and has a circumferential groove 130 therein. The circumferential groove 130 receives an annular bead 134 which is formed on the interior wall of the tip 34, near the rear end thereof, as shown in FIGS. 16 and 22.

THE TIP AND PISTON ASSEMBLIES 32, 232 AND 332

As noted above, there are three embodiments of the disposable tip and piston assembly of the present invention illustrated in the drawings. The tip and piston assembly 32 shown in FIGS. 3, 4, 15, 16, 21 and 22 is of a medium size. The tip and piston assembly 232 of FIGS. 23–25 is a relatively small size. The assembly 332 shown in FIGS. 26–28 is relatively large.

Figure 22:
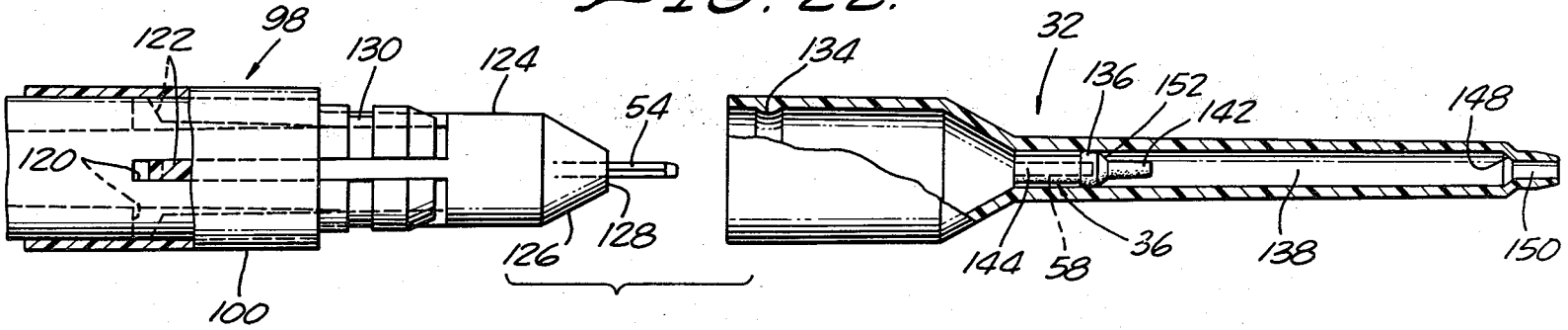
FIG. 22 is a partial sectional view showing the forward end of the pipettor mechanism and the tip and piston assembly in the respective positions occupied just after the tip and piston assembly has been removed or ejected from the forward end of the pipettor mechanism.

Referring to FIGS. 16 and 22, the medium size, disposable tip and piston assembly 32 includes a piston 36 having an annular central portion 136 which engages the wall of the piston chamber 138 in the tip 34. The piston 36 also includes a nose portion 142 and a tail portion 144, each of which is of smaller diameter than the annular central portion 136.

Figure 19:
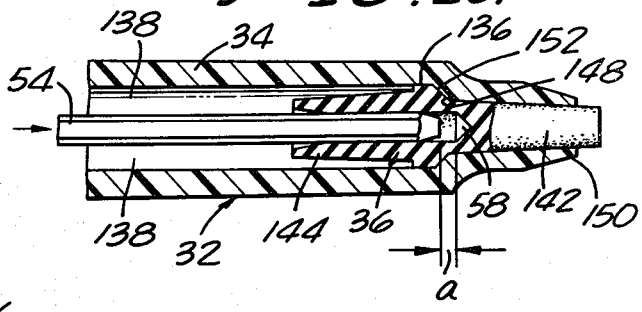
FIG. 19 is a partial sectional view showing the forward end of the tip and piston assembly with the piston located in the forward-most position.

The piston chamber 138 has a bevelled annular surface 148 adjacent its forward end 150; and the piston 36 includes a mating bevelled surface 152 between the nose portion 142 and the central portion 136. As shown in FIG. 19, the bevelled surface 152 of the piston 36 abuts the bevelled surface 148 of the tip 34 to define the forward limit of travel of the piston 36 in the chamber 138. At this forward position (FIG. 19), the nose portion 142 extends through the forward end 150 of the tip to ensure that all of the sample being transferred is expelled from the piston chamber 138.

A bore 58 extends into the tail portion 144 of the piston 36 for receiving the piston rod 54. As best shown in FIGS. 16 and 19, the forward end of the rod 54 is spaced from the bottom of the bore 58 (e.g., by a distance "a") to insure that the length of the stroke of the piston 36 is precisely that defined by the distance between the set screw 70 and the plate 72 (FIGS. 4 and 5).

As best shown in FIGS. 18 and 20, the corners 156 of the hexagonally-shaped piston rod 54 cut into the interior peripheral wall 158 of the bore 58 to provide a relatively tight fit of the rod in the bore.

With reference to FIG. 23, the smaller disposable tip and piston assembly 232 comprises a tip 234 having a cylindrical piston 236 slidably disposed in a piston chamber 238 in the forward portion 240 thereof. The piston 236 is of substantially constant diameter throughout its length so that this relatively small element may be economically molded.

As shown in FIG. 23, the rear end of the tip 234 is provided with an annular bead 235 which engages an annular groove 230 in the forward end 241 of the pipettor housing 40. Inasmuch as FIGS. 23–25 have been included only for the purpose of illustrating a smaller embodiment of a tip and piston assembly 232 constructed in accordance with the teachings of the present invention, and since the pipettor 230 with which the smaller tip and piston assembly 232 is employed is only a smaller version of the pipettor 30 illustrated in FIGS. 1–22, only the forward portion of the pipettor 230 is illustrated in FIG. 23.

The piston rod 254 of the pipettor 230 (FIGS. 23–25) is hexagonally-shaped in cross-section so that the corners thereof dig into the interior peripheral wall of the bore 258 in the piston 236 (see FIG. 24). The forward end of the piston rod 254 terminates at a point spaced from the bottom of the bore 258 by a distance "b" (FIGS. 23 and 25). The space "b" insures precision in the length of the stroke of the piston 236 in the chamber 238, the length of the stroke being defined by the distance between the rear end of the set screw 70 and the forward edge of the plate 72, as shown in FIG. 5.

FIGS. 26–28 illustrate a larger tip and piston assembly 332. The configurations of the piston 336 and the tip 334 of the assembly 332 are similar to the configurations of the piston 36 and the tip 34 of the assembly 32 illustrated in FIGS. 1–22. The primary difference is that the piston 336 is provided with a generally annular wiper blade 337 at its central portion, rather than the cylindrical portion 136 of the piston 36 in the embodiment of FIGS. 1–22 (see, e.g., FIG. 22). The wiper blade configuration 337 of the larger piston 336 of FIGS. 26–28 is preferred, but may not be economically practical in the medium size piston 36 (FIG. 22).

There is a distance "c" provided between the forward end of the piston rod 354 and the bottom of the bore 358 in the piston 336 so as to insure precision of the stroke length of the piston 336 in the piston chamber 338.

OPERATION

The pipettor of the present invention is preferably furnished to the user in the assembled condition shown in the drawings. The set screw 70 (FIGS. 4, 5 and 15) is set in the proper position to define the forward limit of travel of the pin 66 in the slot 68 in the bushing 46. The rear limit of movement of the pin 66 is determined by the metal plate 72 which is molded in the bushing 46. Thus, the metal plate 72 and the set screw 70, by defining the permissible length of travel of the radial pin 66 in the slot 68, define the length of travel of the piston 36 in the piston chamber 138 in the disposable tip 34, to thereby define rather precisely the volume of the substance (e.g., blood) which will be drawn into the piston chamber 138.

When a sample is to be pipetted, the user mounts a tip and piston assembly 32 on the forward end of the housing 40 by sliding the rear portion of the tip 34 over the forward end of the housing 40 until the annular bead 134 snaps into the annular groove 130. (See FIG. 22).

Figure 15:
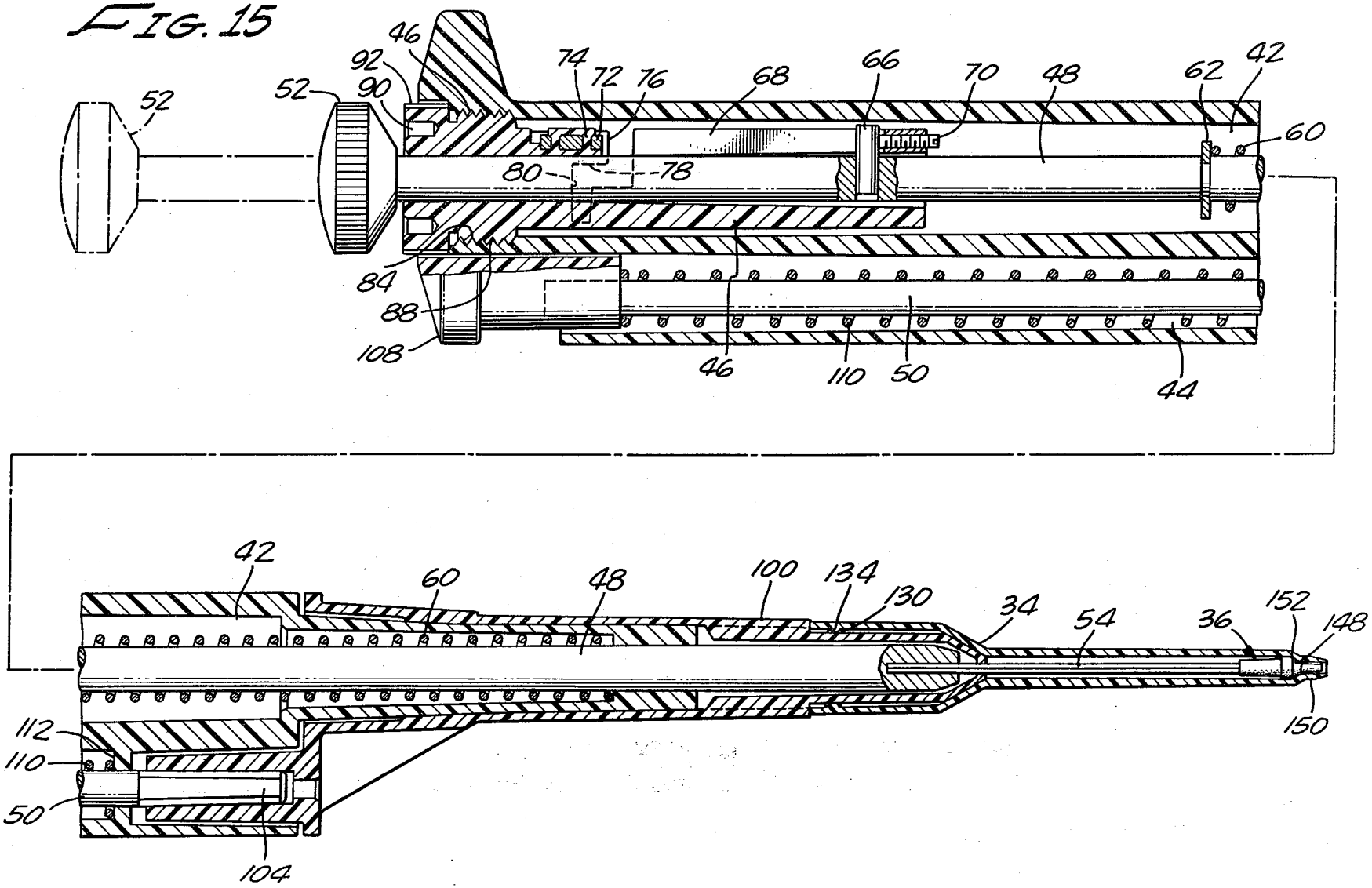
FIG. 15 is a cross-sectional view, similar to FIG. 4, but showing the pipettor mechanism and the tip and piston assembly in the positions occupied when the pipettor mechanism has driven the piston to the forward end of the tip.

Thereafter, the piston plunger 48 is pressed forwardly, via thumb knob 52, to move the forward end of the hexagonal piston rod 54 into the bore 58 in the rear end of the piston 36 until the radial pin 66 contacts the set screw 70, as shown in FIG. 15. In this forward position, the forwardly-facing surface 152 of the piston 36 is seated against the bevelled annular surface 148 adjacent the forward end of the tip 34, and the forward end of the hex rod 54 is spaced rearwardly of the forward end of the bore 58 by a distance ("a") (see FIGS. 16 and 19).

The foregoing step of moving the piston 36 to the forwardmost position in the piston chamber 138 is referred to as "zeroing" the mechanism, or bringing the piston to "zero point."

The user preferably will hold the tip 34 on the forward end of the housing 40 of the pipettor mechanism 30 during the foregoing "zeroing" step to insure that the forward motion of the piston plunger 48 and the hexagonal piston rod 54 does not push the tip 34 off the housing 40.

After the forward end of the hexagonal piston rod 54 has been pushed in to the bore 58 of the piston 36, with the corners of the hexagonal rod embedded in the wall of the bore 58 (see FIG. 20), the plunger knob 52 is released. The return spring 60 will then return the plunger 48 and the hexagonal rod 54 to the rear position shown in FIGS. 4 and 5. In this rear position, the radial pin 66 will contact the metal plate 72, and the piston 36 will be drawn into the rear portion of the piston chamber 138, as shown in FIGS. 4, 16 and 19.

The friction fit between the hexagonal piston rod 54 and the piston 36 is tighter than the friction fit between the central portion 136 of the piston 36 and the interior wall of the piston chamber 138. For this reason, the piston 36 will be drawn rearwardly in the piston chamber 138 as the piston rod 54 and the piston plunger 48 are drawn rearwardly, and the hexagonal piston rod 54 will not pull out of the bore 58.

To draw in a precise quantity of matter (e.g., blood) into the tip 34, the laboratory technician first pushes the piston plunger 48 forwardly (FIGS. 15) to bring the piston 36 into the forward end of the piston chamber 138, and inserts the forward end 150 of the tip 34 into the substance to be sampled. With the mechanism so disposed, the user releases the pressure from the thumb knob 52 of the piston plunger 48, whereby the compressed return spring 60 which bears against the retainer ring 62 (FIG. 4) will bring the piston plunger 48, the hexagonal piston rod 54 and the piston 36 rearwardly in the piston chamber 138 until the radial pin 66 abuts the metal plate 72. There will now be a precise quantity of the substance in the piston chamber 138. The user may then again depress the piston plunger knob 52 to dispense the substance from the chamber 138 into the desired receptacle or onto the desired surface (not shown).

When the pressure is released from the piston plunger knob 52, the return spring will again bring the piston plunger 48, the hexagonal rod 54 and the piston 36 to the positions shown in FIG. 4. When the user desires to eject the contaminated tip and piston assembly, he first locks the piston plunger 48 and piston rod 54 against forward longitudinal movement by first rotating the piston plunger 48 and the dowel pin 66 in a counter-clockwise direction. When the outer portion of the pin 66 reaches the end of forward arcuate slot 76, the return spring 60 urges the pin 66 rearwardly in the rear longitudinal slot 78, and the user again rotates the plunger 42 in a counter-clockwise direction, this time for a short distance (e.g., 5°) in the rear arcuate slot 80.

With the pin 66 in the rear arcuate slot 80, the piston plunger rod 48 and the piston rod 54 are locked against inadvertent longitudinal motion. The piston 36 may then be pushed off of the forward end of the piston rod 54 by depressing the knob 108 of the ejector plunger 50 as shown in FIGS. 21 and 22. The forward end 104 of the plunger 50 forces the ejector sleeve 100 forwardly, via the offset extension 102. As the ejector sleeve 100 moves forwardly, it carries the tip member 34 forwardly, whereupon the interior annular bead 134 moves out of the annular groove 130 in the forward end of the housing 40. When the sleeve 100 has moved forwardly by an amount exceeding the axial length of the section 131 on the forward end of housing 40, (i.e., so that the annular bead 134 clears the section 131) the tip 34 will drop off of the forward end of the ejector sleeve 100. It is to be noted that the interior diameter of the annular bead 134 is slightly larger than the exterior diameter of the forward end portion of the ejector sleeve 100. For example, the interior diameter of the annular bead 134 may be approximately 0.300 of an inch, and the exterior diameter of the forward end portion 124 of the ejector sleeve 100 may be approximately 0.290 of an inch.

As the ejector sleeve 100 moves forwardly, (i.e., from the position of the sleeve 100 shown in FIG. 4 to the position shown in FIG. 21), the forwardly-facing annular surface 128 at the forward end of the ejector sleeve 100 will engage the rear end of the piston 36 (see FIG. 4*b*, for example) whereupon further forward movement of the ejector sleeve 100 and the forward end 128 thereof (FIG. 21) will push the piston 36 off of the hexagonal piston rod 54. The piston 36 will then be left in the piston chamber 138 (as shown in FIG. 22) and will remain there as the tip 34 drops off of the pipettor housing 40.

It will thus be appreciated that the tip and piston assembly 32 may be ejected from the pipettor mechanism 30 without the need for the user to come into contact with the contaminated assembly.

PREFERRED MATERIALS

While various materials may be used in constructing the components of the pipettor mechanism and the disposable tip and piston assembly described above and illustrated in the accompanying drawings, to date it appears that the various parts may be constructed of the materials set forth below.

The housing 40 and the ejector sleeve 100 of the pipettor may be constructed of a chemically resistant, relatively rigid plastic, such as glass filled polyphenyl sulfide, for example.

The springs shaft, rods and pins may be made of stainless steel.

The knobs 52 and 108 and the bushing 46 may be made of polyester.

The tip 34 may be made of polypropylene which is highly chemically resistant.

The piston 36 may be made of polyethylene which provides for an effective sliding seal.

It is contemplated that various modifications may be made to the exemplary embodiments of the present invention described above and illustrated in the accompanying drawings without departing from the spirit and scope of the invention. Accordingly, it is intended that this patent be limited only by the scope of the following claims.

We claim:

1. In a disposable tip and piston assembly for use with a pipettor having a housing and a plunger reciprocal in the housing, said disposable piston and tip assembly comprising:

a tip member and a piston member disposed in said tip member, whereby a fluid may be drawn into said tip member and dispensed therefrom by moving said piston member rearwardly and forwardly in said tip member, the improvement comprising:

means on said tip member for detachably mounting said tip member on the housing of a pipettor; and said piston member including means for detachable connection to the plunger of a pipettor;

said piston member being substantially shorter in length than said tip member such that the end of the plunger of a pipettor with which said disposable tip and piston assembly is adapted for use extends substantially into the tip member when connected to the piston member and the piston member is at its forwardmost position in the tip member.

2. The improved tip and piston assembly claimed in claim 1, wherein said detachable connection means of said piston member comprises an opening in the rear of said piston member, said opening being adapted to receive the end of the plunger of a pipettor with which said disposable tip and piston assembly is adapted for use.

3. The improved tip and piston assembly claimed in claim 2, wherein the opening in the rear of said piston assembly is adapted to receive the end of a plunger whose cross-sectional shape is polygonal.

4. The improved tip and piston assembly claimed in claim 3, wherein said opening is adapted to receive the end of a plunger which is hexagonal in cross-section.

5. An assembly as in claim 1, wherein said tip member includes an interior wall; wherein the piston member includes an annular central portion having an outer surface in sliding contact with said interior wall, the annular central portion of said piston member being slightly greater in diameter than said interior wall of the tip member to define a sliding function fit therebetween, said central portion of the piston member being of a softer material than said interior wall of said tip member; wherein said piston member includes means defining a bore therein for frictionally receiving the end of a plunger rod in a pipettor mechanism; and wherein the diameter of the bore is such that the friction fit of a plunger rod therein will be tighter than the friction fit between said annular central portion of said piston member and the interior wall of the tip.

6. In a pipettor mechanism comprising a housing and a plunger member mounted therein for extension and retraction relative to the housing, said plunger member having a forward end, the improvement comprising means on said forward end of said plunger member for detachably retaining a piston of a disposable tip and piston assembly, said retaining means being sized to move freely in said disposable tip and piston assembly when said piston is detachably retained thereto, whereby the mechanism may be used to pipette a substance into and out of a disposable tip member without contaminating the mechanism.

7. A mechanism as in claim 6, wherein the forward end of the plunger member is polygonal in cross-section and has a plurality of corners, the plurality of corners being adapted to embed in the interior wall of a bore in the piston of a disposable tip and piston assembly.

8. A mechanism as in claim 7, in which the rod is hexagonal in cross-section.

9. A mechanism as in claim 6, and further comprising means for ejecting from the mechanism both the piston and the tip of a disposable tip and piston assembly; said ejection means including separate means for engaging the piston and the tip and forcing the piston from the plunger and the tip from the housing.

10. A pipettor mechanism as defined in claim 9, wherein said ejector means includes tip engaging means for engaging the tip, and piston engaging means for engaging the piston of a tip and piston assembly.

11. A pipettor for use with a disposable tip and piston assembly, comprising: a housing; a plunger movable in the housing; and an ejector mechanism; said plunger having a forward end adapted to detachably engage the piston of a disposable tip and piston assembly and being sized to move freely in said assembly when the piston is detachably engaged thereby; said ejector including means for substantially simultaneously ejecting a disposable tip and a piston therewithin from the pipettor, including means for removing a piston from the forward end of the plunger.

12. A pipettor as in claim 11, and further comprising means for immobilizing the plunger during operation of the ejector mechanism.

13. A pipettor as in claim 11, wherein said ejector mechanism includes an injector plunger movable in the housing and an ejector sleeve mounted for sliding movement relative to the housing, said ejector sleeve and said housing having forward end portions, and further comprising cooperating slots and slats on said forward portions of said sleeve and said housing.

14. A pipettor as in claim 12, in which the housing includes a bushing in the rear end portion of the housing, in which a portion of the plunger is slidably movable, and in which the immobilizing means comprise a pin projecting radially from the plunger in the portion slidably movable in the bushing, and a slot in the bushing in which the pin rides, the axial end portions of said slot limiting travel of the plunger.

15. A pipettor as in claim 13, in which the ejector sleeve has a bore in the rear thereof, and in which the forward end of the ejector plunger is polygonal in cross-section, including a plurality of corners, the plurality of corners forming edges adapted to be detachably embedded in the wall of the bore of the ejector sleeve.

16. A mechanism as in claim 14, in which the bushing slot includes offset forwardly and rearwardly-extending axial portions, and offset forwardly and rearwardly-extending arcuate portions interconnecting the axial portions.

17. A mechanism as in claim 15, in which the ejector plunger is hexagonal in cross-section.

18. In a pipettor and disposable tip combination, wherein the disposable tip is detachably mounted on the end of the pipettor for receiving a sample to be transferred; and wherein said pipettor includes a plunger mechanism; and wherein said pipettor further includes an ejector mechanism for ejecting the disposable tip from the pipettor;

the improvement comprising:

a piston member slidably disposed within said disposable tip;

said piston member being of a softer material than said disposable tip and having a slightly larger diameter than the diameter of the interior wall of the tip, whereby a sliding friction fit is established between said piston and said interior wall of said tip;

and wherein said piston member has a bore therein;

said plunger mechanism including a plunger rod having a forward end which is removably inserted in said bore in said piston member, there being a friction fit of the plunger rod in the bore;

the friction fit of the plunger rod in the bore being less than the friction fit between said piston and the interior wall of said tip, whereby the piston may be reciprocated in said tip without removing the plunger rod from the bore;

said ejector mechanism including means for simultaneously removing the tip from the pipettor and the piston from the plunger rod.

* * * * *